US009689110B2

(12) United States Patent
Massey, Jr.

(10) Patent No.: US 9,689,110 B2
(45) Date of Patent: Jun. 27, 2017

(54) COLLAPSIBLE MULTI-PURPOSE STRUCTURE

(71) Applicant: William Yates Massey, Jr., Clinton, MD (US)

(72) Inventor: William Yates Massey, Jr., Clinton, MD (US)

( * ) Notice: Subject to any disclaimer, the term of this patent is extended or adjusted under 35 U.S.C. 154(b) by 111 days.

(21) Appl. No.: 14/510,718

(22) Filed: Oct. 9, 2014

(65) Prior Publication Data

US 2016/0101889 A1 Apr. 14, 2016

(51) Int. Cl.
*B65D 81/36* (2006.01)
*D06F 95/00* (2006.01)

(52) U.S. Cl.
CPC ..... *D06F 95/002* (2013.01); *B65D 81/36* (2013.01)

(58) Field of Classification Search
None
See application file for complete search history.

(56) References Cited

U.S. PATENT DOCUMENTS 680,225 A 8/1901 Chorlton
684,232 A 10/1901 Harrison
700,798 A 5/1902 Morris
2,010,441 A * 8/1935 Scott ..... B65D 9/18 217/12 A
2,180,691 A * 11/1939 Olivier ..... B65D 5/2004 206/766
2,625,973 A 1/1953 Weldon et al.
3,369,652 A * 2/1968 Bebout ..... B65D 85/185 206/280
3,446,384 A * 5/1969 Blackman ..... B65D 9/14 217/14
3,611,994 A * 10/1971 Bailey ..... B65D 7/26 119/496
4,036,361 A 7/1977 Jacobson et al.
4,512,477 A * 4/1985 Densen ..... A47B 43/02 206/292
D344,823 S 3/1994 Wilgus et al.
D413,699 S 9/1999 Evans
5,967,342 A * 10/1999 Steffine ..... D06F 95/002 211/85.15
6,460,556 B2 10/2002 Zheng
6,494,335 B1 12/2002 Kellogg et al.
6,935,526 B1 * 8/2005 Laggar ..... E05G 1/00 220/4.29
7,251,909 B2 8/2007 Gameiro
(Continued)

OTHER PUBLICATIONS

Neatfreak Triple Sorter with Ironing Board, Bed Bath & Beyond(http://www.bedbathandbeyond.com/store/product/neatfreak-triple-sorter-with-ironing-board/1018117096) (first accessed Jun. 2014).

*Primary Examiner* — Gary Elkins
(74) *Attorney, Agent, or Firm* — Rothwell, Figg, Ernst & Manbeck

(57) ABSTRACT

A collapsible structure that includes an openable end panel, three foldable side panels, an openable side panel, a partial side panel, and a removable end panel. At least a portion of the foldable side panels, openable side panel, and partial side panel may be connected by seams which may permit the panels to fold into a hamper state, an ironing board state, a laundry bin, state, and collapsible state. The collapsible state permits the user to efficiently store the collapsible structure when not in use.

20 Claims, 7 Drawing Sheets

(56) References Cited

U.S. PATENT DOCUMENTS

| | | | | |
|---|---|---|---|---|
| 7,310,898 | B2 * | 12/2007 | Wei | D06F 81/08 38/107 |
| 8,978,912 | B1 * | 3/2015 | Kraeling | B65D 37/00 220/4.28 |
| 2005/0077292 | A1 * | 4/2005 | Devine | F16L 59/02 220/6 |
| 2005/0207682 | A1 * | 9/2005 | Stager | A45C 9/00 383/104 |
| 2007/0200471 | A1 * | 8/2007 | Boone | D06F 95/002 312/211 |
| 2012/0267365 | A1 | 10/2012 | Sabounjian | |
| 2014/0126844 | A1 * | 5/2014 | Lowry | B65D 19/0012 383/121.1 |
| 2015/0076799 | A1 * | 3/2015 | Ryan | B62B 3/02 280/651 |

* cited by examiner

COLLAPSIBLE MULTI-PURPOSE STRUCTURE

BACKGROUND

Field of Invention

The present invention relates generally to a multi-purpose structure that can collapse for storage. Specifically, the present invention relates to a structure that utilizes foldable, openable, and removable panels, such that the structure can be readily modified to become a clothes hamper, a laundry bin, and an ironing board, as well as collapse for storage.

Discussion of the Background

A typical apartment or dormitory often encounters the need for a clothes hamper to temporarily store garments before washing. Regardless of the place where laundry is done, whether at home or a commercial laundry facility, soiled garments typically need to be transported to a designated place for washing. Often garments must be ironed to smooth away wrinkles and give them a professional look. Additionally, a typical apartment or dormitory often encounters the need for temporary storage of a clothes hamper, laundry bin, or ironing board when not in use, to preserve space within the apartment or dormitory.

Devices are known in the art that provide containers for storing garments and a surface for ironing garments. For example, the Neatfreak™ Triple Sorter with Ironing Board provides an ironing board with three storage bins located beneath the ironing board. However, such devices fail to provide a collapsible structure that can be readily folded for storage within an apartment or dormitory to preserve space when the device is not in use.

Thus, there is presently a need in the art for a collapsible structure that can provide not only the multi-purpose functionality of garment storage, transport, and ironing, but that is also readily foldable for efficient storage when the structure is not in use.

SUMMARY

The present invention overcomes the disadvantages of prior devices by providing, among other advantages, a multi-purpose container and structure that can be utilized for garment storage, transportation, and ironing, and that can also be collapsed by folding the structure to allow for easy storage within a typical apartment or dormitory.

One aspect of the invention may provide a collapsible structure. The collapsible structure may include a removable end panel, an openable end panel, a partial side panel, an openable side panel, a first foldable side panel, a second foldable side panel, and a third foldable side panel. The collapsible structure may also include a first seam configured to connect the openable end panel to the partial side panel and configured to permit the openable end panel to pivot about the first seam from a first closed position to a first open position, a second seam configured to connect the first foldable side panel to the partial side panel, a third seam configured to connect the first foldable side panel to the second foldable side panel, and a fourth seam configured to connect the second foldable side panel to the third foldable side panel. The collapsible structure may further include a fifth seam configured to connect the third foldable side panel to the openable side panel and the partial side panel, and configured to connect the partial side panel to the openable side panel, and wherein the fifth seam is configured to permit the openable side panel to pivot about the fifth seam from a second closed position to a second open position. The openable side panel may be configured to be temporarily attached to the first foldable side panel, while the openable end panel may be configured to be temporarily attached to the second side panel. The removable end panel may be configured to connect to one or more of the first foldable side panel, the second foldable side panel, and/or the third foldable side panel by one or more attachment. The first foldable side panel, the second foldable side panel, the third foldable side panel, the openable side panel, the partial side panel, and the foldable end panel may be configured to fold into a collapsed state when the removable end panel is not connected to one or more of the first foldable side panel, the second foldable side panel, and/or the third foldable side panel, and the openable end panel is not in the first closed position.

In another aspect of the invention, the collapsible structure may include a support which may be configured to secure the openable end panel in the first open position such that the openable end panel is parallel with the openable side panel. The support may configured to be permanently affixed to the openable end panel and temporarily attached to the first foldable side panel. Alternatively, the support may be configured to be permanently affixed to the first foldable side panel and temporarily attached to the openable end panel. Further, the support may be configured to be temporarily attached to the first foldable side panel and temporarily attached to the openable end panel.

In yet another aspect of the invention, the collapsible structure may include a storing mechanism configured to store the support when the support is not positioned to secure the openable end panel in the open position.

In still another aspect of the invention, the collapsible structure may include one or more ventilation holes.

In yet another aspect of the invention, the collapsible structure may include a partial foldable end panel configured to be temporarily attached to the first foldable side panel while in a third open position, and configured to be temporarily attached to the third foldable side panel while in a third closed position.

In another aspect of the invention, the removable end panel of the collapsible structure may include a first handle and the openable end panel may include a second handle. In one aspect of the invention, the first and second handles may be formed by removed portions of each of the removable end panel and the openable end panel.

Still another aspect of the invention may provide a collapsible structure that may include a removable end panel that may be configured to connect to one or more of the first foldable side panel, the second foldable side panel, and/or the third foldable side panel by a groove-and-tongue mechanism. In another aspect of the invention, the removable end panel may be configured to connect to one or more of the first foldable side panel, the second foldable side panel, and/or the third foldable side panel by Velcro. In yet another aspect of the invention, the removable end panel may include one or more seams, such that the removable end panel is configured to be folded into a collapsed position.

Further variations encompassed within the apparatus are described in the detailed description of the invention below.

BRIEF DESCRIPTION OF THE DRAWINGS

The accompanying drawings, which are incorporated herein and form part of the specification, illustrate various, non-limiting embodiments of the present invention. In the drawings, like reference numbers indicate identical or functionally similar elements.

DETAILED DESCRIPTION OF PREFERRED EMBODIMENTS

Figure 1A:
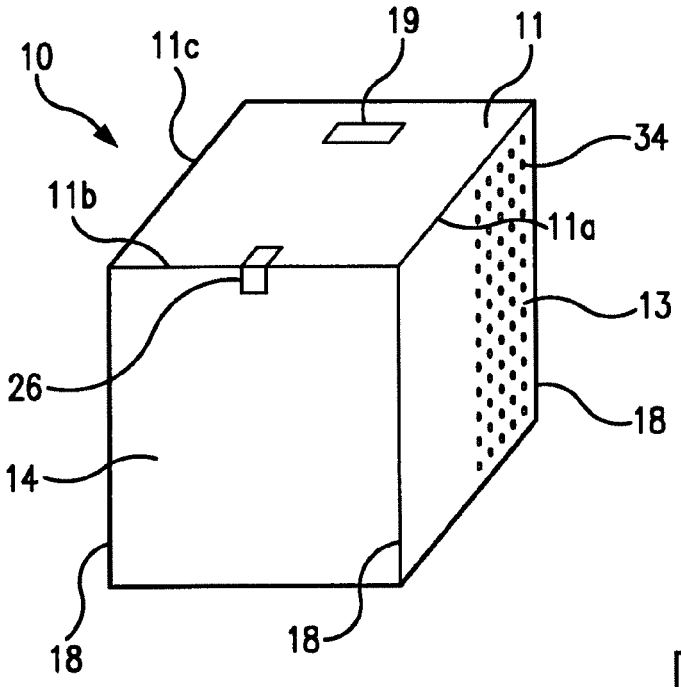
FIGS. 1A-B illustrate perspective views of the collapsible structure while in the hamper state.

FIGS. 1A-7 illustrate collapsible structure 10 embodying aspects of the present invention. In one non-limiting embodiment, collapsible structure 10 may include an openable end panel 11, three foldable side panels 13, 14, and 15, an openable side panel 16, partial side panel 17, and a removable end panel 12. At least a portion of foldable side panels 13, 14, and 15, openable side panel 16, and partial side panel 17 may be connected by seams 18 which may permit panels 13, 14, 15, 16, and 17 to fold into a collapsible state. Collapsible structure 10 may be metal, wood, polymeric or any other material known in the art to be suitable to structurally support the structure while in the hamper, laundry bin, or ironing board states, as described below, while also suitable for the formation of connecting seams that allow the connected panels to fold and also suitably heat-resistant to avoid catching fire or combustion during ironing.

FIGS. 1A and B are perspective views of collapsible structure 10 while in the hamper state. Removable end panel 12 (not shown) may serve as a base for the collapsible structure 10, while in the hamper state. Foldable side panels 13, 14, and 15 and openable side panel 16 may form the walls of the collapsible structure 10 and define an interior enclosure for storing garments or other objects, while in the hamper state. Openable side panel 16 may be held in a closed position by attachment 28 and reciprocating attachment 29, which provide secure attachment between openable side panel 16 and foldable side panel 15, as shown in, for example, FIG. 2A. Secure attachment between attachment 28 and reciprocating attachment 29 (see, e.g., FIG. 4) may be accomplished through the use of a latch mechanism, button mechanism, clamp mechanism, Velcro, groove-and-tongue, tab-and-slot, male-female connection, or any other suitable means that may connect attachment 28 and reciprocating attachment 29. Additionally, foldable end panels 13 and 15 may include one or more ventilation holes 34 to permit the ventilation of soiled garments. The sizes, shapes, orientation, configuration, and numbers of the ventilation holes shown in FIGS. 1A-7 are not intended to be limiting; the size of the one or more ventilation holes may be larger or smaller (and of different shape) and of different orientation or configuration than shown. Additionally, the location of ventilation holes 34 as shown in FIGS. 1A-7 is not intended to be limiting. Ventilation holes may appear on any panel of the collapsible structure.

FIG. 1A shows openable end panel 11 in a closed position such that the edges 11*a*, 11*b*, and 11*c* of openable end panel 11 abut the top edges of side panels 13, 14, and 15. Openable end panel 11 may be held in the closed position by secure attachment between attachment 26 and reciprocating attachment 27 (see also, FIG. 1B), which may be accomplished through the use of a latch mechanism, button mechanism, clamp mechanism, Velcro, groove-and-tongue, tab-and-slot, male-female connection, or any other suitable means that may connect attachment 26 and reciprocating attachment 27.

Figure 1B:
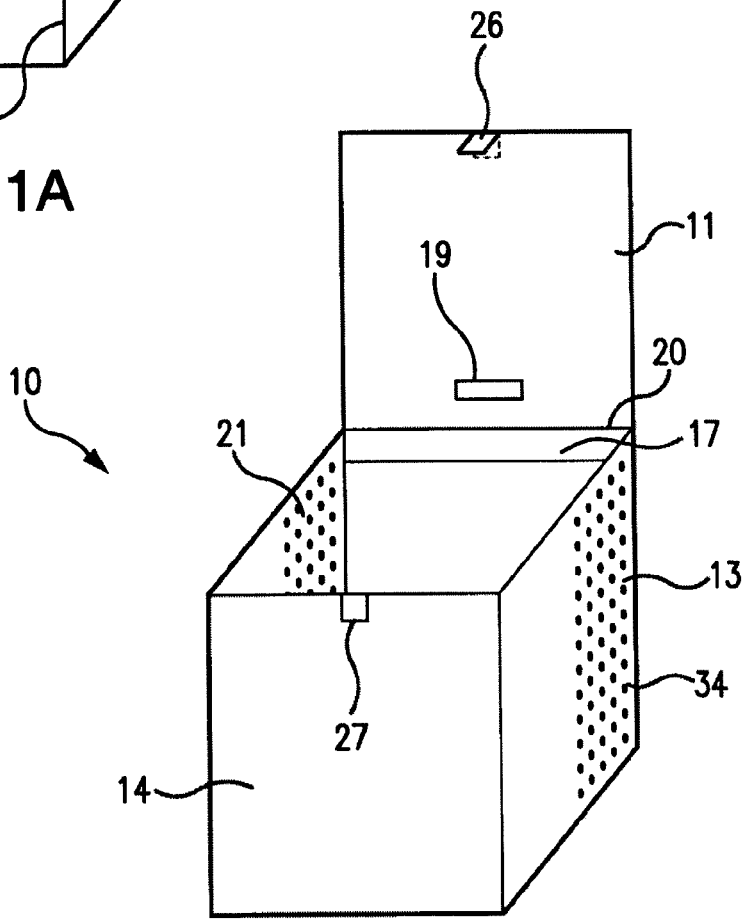

FIG. 1B shows openable end panel 11 in an open position, exposing opening 21 to allow a user to store garments or other objects within collapsible structure 10 while in the hamper state. Openable end panel 11 may be permitted to move from the open position to the closed position by a pivoting movement on seam 20, which may connect at least a portion of openable end panel 11 to partial side panel 17.

Figure 2A:
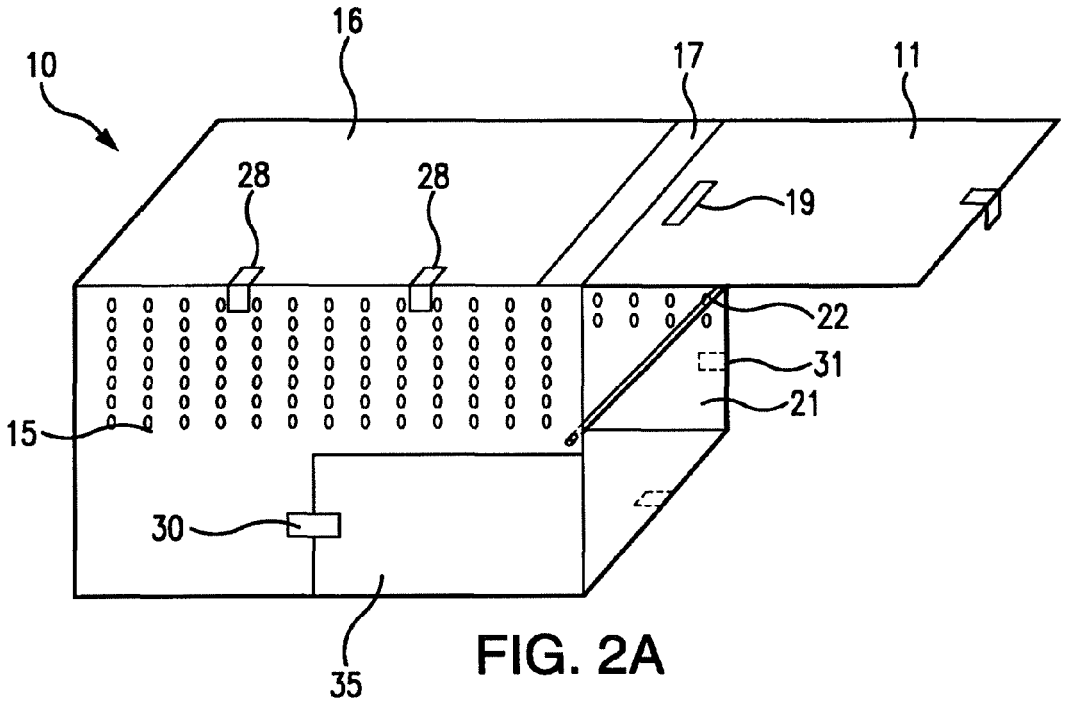
FIGS. 2A-B illustrates perspective views of the collapsible structure while in the ironing board state.
Figure 2B:
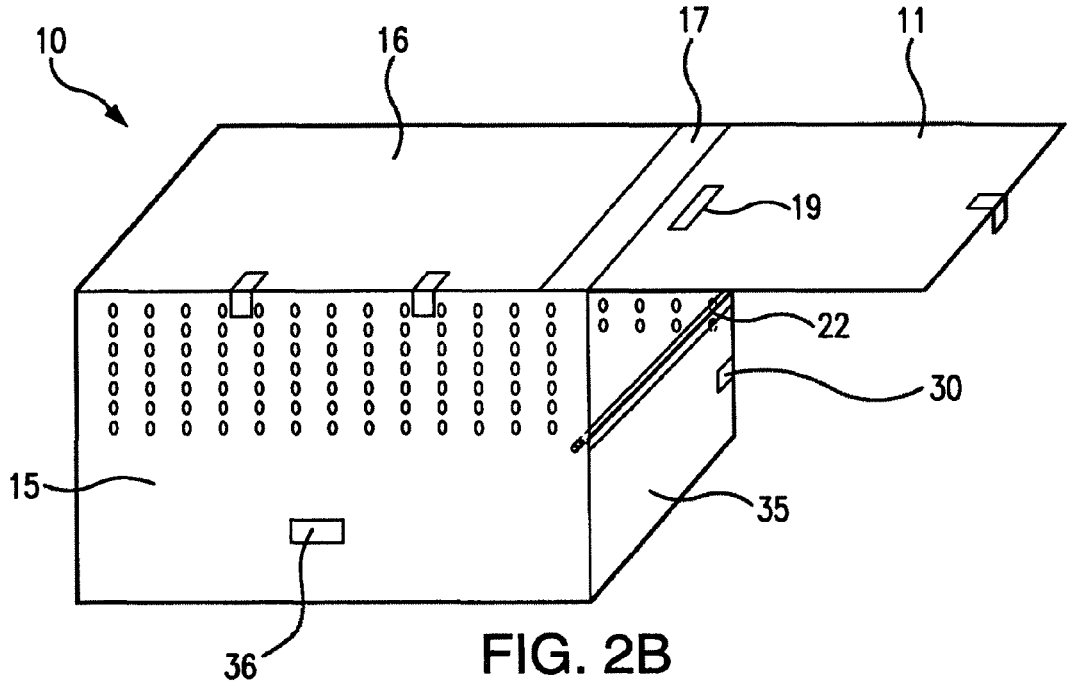
Figure 3:
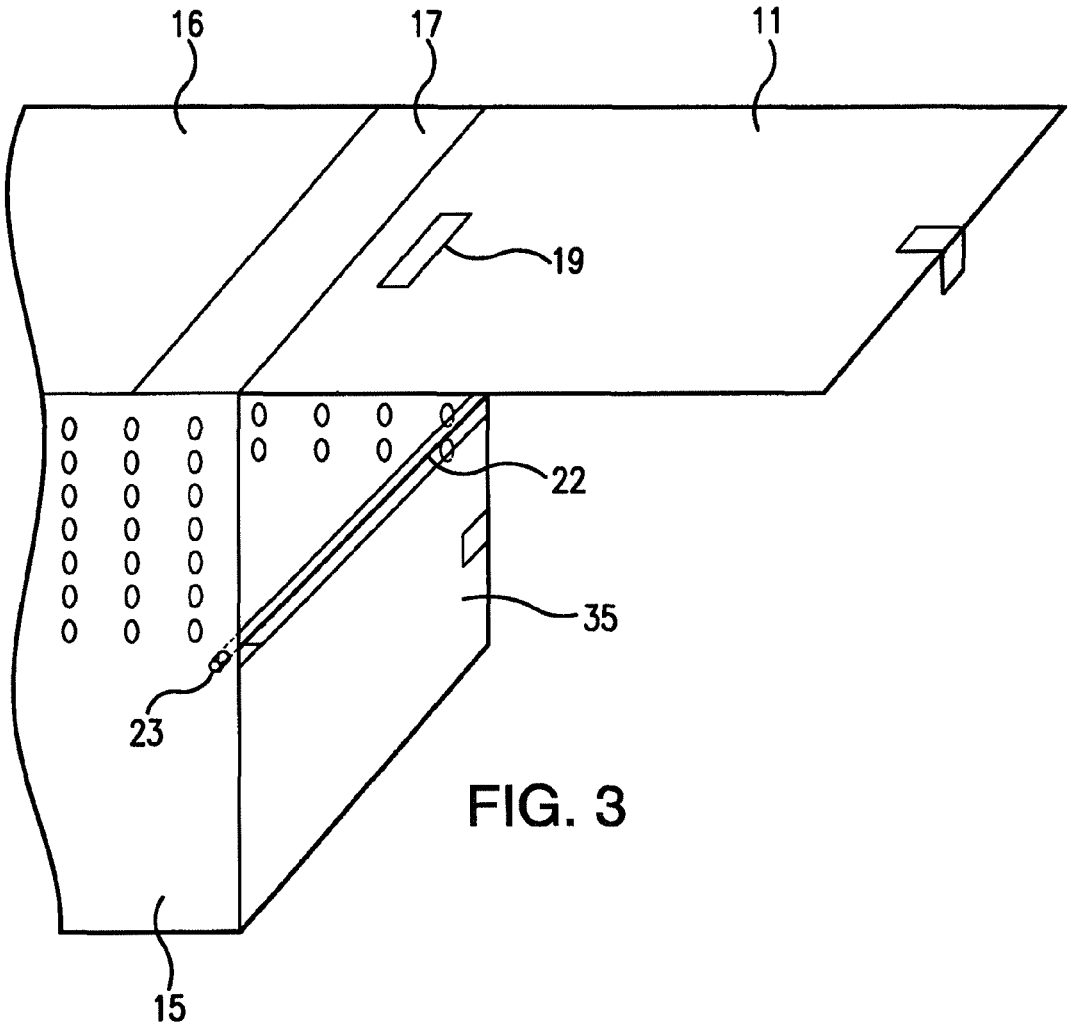
FIG. 3 illustrates a close-up view of the collapsible structure while in the ironing board state.

FIGS. 2A and B illustrate perspective views of collapsible structure 10 while in the ironing board state. As shown in FIG. 2A, openable side panel 16, partial side panel 17, and openable end panel 11 may provide a surface on which a user may iron garments. In the ironing board state, openable side panel 16 is held in a closed position by attachment 28 and reciprocating attachment 29, as described above. Additionally, as shown in FIGS. 2A, 2B, and 3, while in the ironing board state, openable end panel 11 may be secured in the open position, by one or more support structures 22, such that openable end panel 11 is parallel with openable side panel 16 and partial side panel 17. The parallel surface of openable end panel 16, partial side panel 17, and openable end panel 11 may allow a user to iron clothes in a similar manner to conventional ironing boards.

FIG. 3 is a close-up view of the collapsible structure while in the ironing board state. In one non-limiting embodiment, one or more support structures 22 may be permanently affixed to openable end panel 11 by a hinge-type mechanism (not shown), such that one or more support structures 22 may pivot about the hinge-type affixture and be temporarily, yet securely attached to foldable side panel 15. In one non-limiting embodiment, the secure attachment between the one or more support structures 22 and foldable side panel 15 may be accomplished by inserting the free-end (not affixed to openable end panel 11) of the one or more support structures 22 into opening or hole 23, such that openable end panel 11 may be secured in the open position and parallel with openable side panel 16 (in the closed position) and partial side panel 17. In other non-limiting embodiments, one or more support structures 22 may be clamped, fastened, hooked, latched, or otherwise connected to foldable side panel 15, such that openable end panel 11 may be secured in the open position and parallel with openable side panel 16 (in the closed position) and partial side panel 17. In non-limiting embodiments in which one or more support structures 22 is permanently affixed to openable end panel 11, openable end panel 11 may further comprise a clamp, hook, latch, or similar mechanism in which to secure the free-end of the one or more support structures 22, when collapsible structure 10 is not in the ironing board state.

Alternatively, in one non-limiting embodiment, one or more support structures 22 may be permanently affixed to foldable side panel 15 by a hinge-type mechanism (not shown), such that one or more support structures 22 may pivot about the hinge-type affixture and be temporarily, yet securely attached to openable end panel 11. In one non-limiting embodiment, the secure attachment between one or more support structures 22 and openable end panel 11 may be accomplished by inserting the free-end (not affixed to foldable side panel 15) of one or more support structures 22 into an opening or hole (not shown) of openable end panel 11, such that openable end panel 11 may be secured in the open position and parallel with openable side panel 16 and partial side panel 17. In one non-limiting embodiments, one or more support structures 22 may be clamped, fastened, hooked, latched, or otherwise connected to openable end panel 11, such that openable end panel 11 may be secured in the open position and parallel with openable side panel 16 and partial side panel 17. In non-limiting embodiments in which one or more support structures 22 is permanently affixed to foldable side panel 15, foldable side panel 15 may further comprise a clamp, hook, latch, or similar mechanism in which to secure the free-end of the one or more support structures 22, when collapsible structure 10 is not in the ironing board state.

In a further alternative non-limiting embodiment, one or more support structures 22 may be temporarily, yet securely attached to foldable side panel 15 and temporarily, yet securely attached to openable end panel 11. In one non-limiting embodiment, the temporary, secure attachments between one or more support structures 22 and openable end panel 11 and foldable side panel 15 may be accomplished by inserting one end of the one or more support structures 22 into an opening or hole 23 in foldable side panel 15 and by inserting the other end of the one or more support structures 22 into an opening or hole (not shown) in openable end panel 11, such that openable end panel 11 may be secured in the open position and parallel with openable side panel 16 and partial side panel 17. In other non-limiting embodiments in which one or more support structures 22 is not permanently affixed to foldable side panel 15 or openable end panel 11, one or more support structures 22 may be clamped, fastened, hooked, latched, or otherwise connected to foldable side panel 15 and openable end panel 11, such that openable end panel 11 may be secured in the open position and parallel with openable side panel 16 and partial side panel 17. In non-limiting embodiments in which one or more support structures 22 is not permanently affixed to foldable side panel 15 or openable end panel 11, collapsible structure 10 may comprise a clamp, hook, latch, groove, pocket, or similar mechanism in which to secure one or more support structures 22, when collapsible structure 10 is not in the ironing board state and one or more support structures 22 is not in use.

The size, shape, orientation, configuration, and number of the one or more support structures shown in FIGS. 2A, 2B, and 3 are not intended to be limiting; the size of the support may be larger or smaller (and of different shape and of different orientation or configuration) than shown. For example, in one non-limiting embodiment, collapsible structure 10 may include one or more support that is connected to foldable side panel 13 and openable end panel 11, such that openable end panel 11 may be secured in the open position and parallel with openable side panel 16 and partial side panel 17. Additionally, collapsible structure 10 may include more than one support structure to secure the openable end panel 11 in the open position. For example, in one non-limiting embodiment, the collapsible structure may include one or more support structure that is connected to foldable side panel 13 and openable side panel 11 and one or more support that is connected to foldable side panel 15 and openable end panel 11, such that openable end panel 11 may be secured in the open position and parallel with openable side panel 16 and partial side panel 17. Additionally, a support structure such as a hook, latch, sliding support, or other suitable mechanism may be provided between the partial side panel 17 and openable end panel 11 that is configured to secure openable end panel 11 in the open position, such that openable end panel 11 may be secured in the open position and parallel with openable side panel 16 and partial side panel 17. These embodiments are not intended to be limiting.

Returning to FIGS. 2A and 2B, in one non-limiting embodiment, the collapsible structure 10 may also include a partial foldable end panel 35. As shown in FIG. 2A, the partial foldable end panel 35 may be securely attached to foldable side panel 15 in an open position by secure attachment between attachment 30 and reciprocating attachment 35, which may be accomplished through the use of a latch mechanism, button mechanism, clamp mechanism, Velcro, male-female connection, or any other suitable means that may connect attachment 30 and reciprocating attachment 36. While the partial foldable end panel 35 is in the open position (i.e. securely attached to foldable side panel 15), opening 21 may permit a user full access to garments stored within collapsible structure 10, while in the ironing board state.

As shown in FIG. 2B, the partial foldable end panel 35 may be securely attached to foldable side panel 13 in a closed position by secure attachment between attachment 30 and reciprocating attachment 31, which may be accomplished through the use of a latch mechanism, button mechanism, clamp mechanism, Velcro, male-female connection, or any other suitable means that may connect attachment 30 and reciprocating attachment 31. While the partial foldable end panel 35 is in the closed position (i.e. securely attached to foldable side panel 13), opening 21 may permit a user partial access to garments stored within collapsible structure 10, and partial foldable end panel 35 may prevent garments from falling out of the interior enclosure defined by foldable side panels 13, 14, and 15, openable side panel 16 (in the closed position), partial side panel 17, and removable end panel 12, while in the ironing board state.

Figure 4:
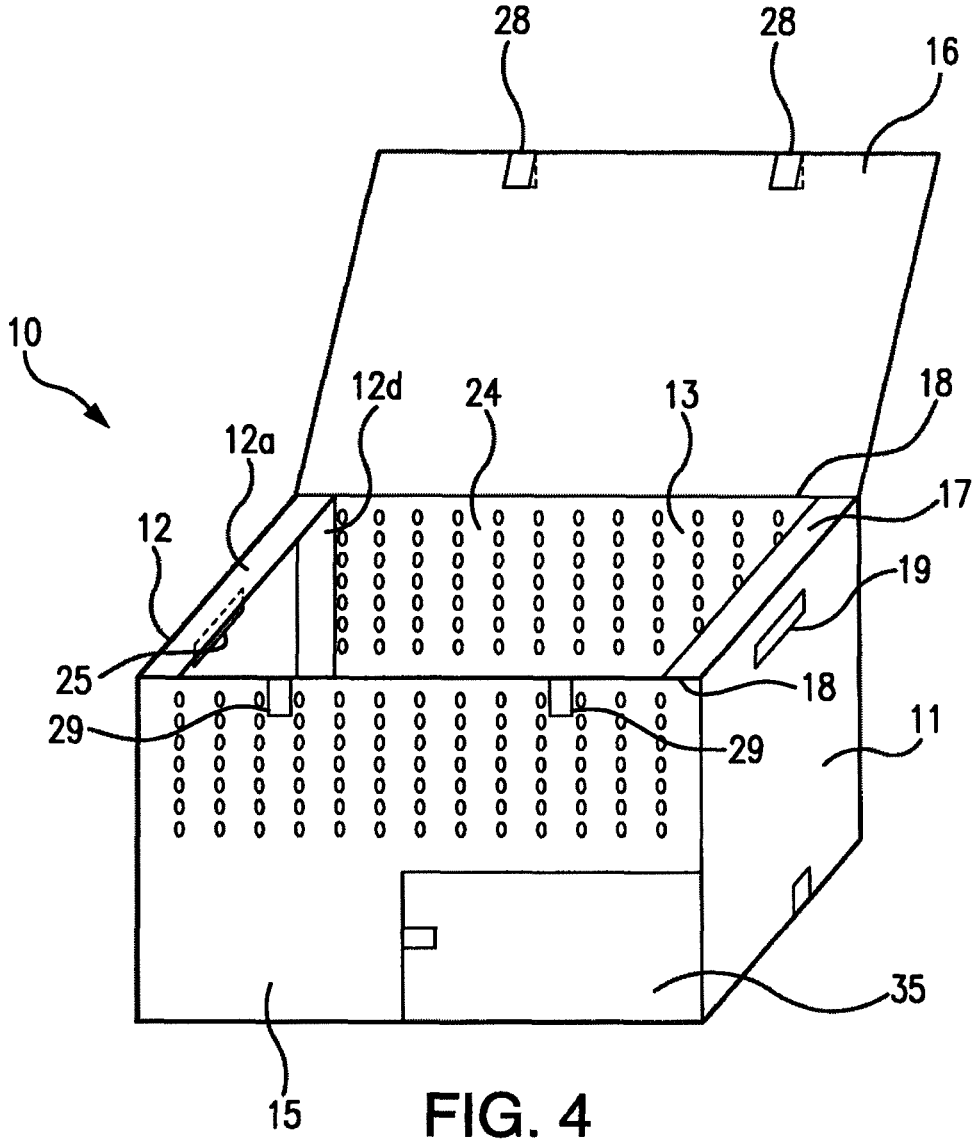
FIG. 4 illustrates a perspective view of the collapsible structure while in the bin state.

FIG. 4 is a perspective view of collapsible structure 10 while in the laundry bin state. In the laundry bin state, collapsible structure 10 may include an interior enclosure defined by foldable side panels 13, 14, and 15, openable end panel 16 (in the closed position), and openable end panel 11, and removable end panel 12. While in the laundry bin state, openable end panel 11 is in the closed position and securely attached to foldable side panel 14, as described above. When transporting clothes, for example, openable side panel 16 may remain in the closed position, in which openable side panel 16 may be securely attached to side panel 15, as described above. However, as shown in FIG. 4, openable side panel 16 may be moved to an open position to create opening 24, thus permitting a user to place garments or other objects in the collapsible structure or to access garments stored within the enclosure formed by the side and end panels. Again, collapsible structure 10 may include one or more ventilation holes 34 to permit the ventilation of soiled garments or, to permit ventilation of warm clothes after removal from a dryer.

Openable end panel 11 and removable end panel 12 may include handles 19 and 25, respectively, to permit a user to lift and transport collapsible structure 10 (and the contents therein) while in the bin state. In one non-limiting embodiment, handles 19 and 25 may be formed by cutting out or removing portions of end panels 11 and 12. In another non-limiting embodiment, handles 19 and 25 may be formed by an extension of end panels 11 and 12. In a further non-limiting embodiment, handles 19 and 25 may be formed by a strap or an addition to end panels 11 and 12. The size, shape, orientation, and configuration of the handles shown in FIGS. 1-7 are not intended to be limiting; the size of the handles may be larger or smaller (and of different shape and of different orientation or configuration) than shown.

Collapsible structure 10 may also include one or more mechanisms by which removable end panel 12 may be securely attached to one or more foldable side panels 13, 14, and 15. In one non-limiting embodiment, removable end panel 12 may be securely attached to one or more of the edges of side panels 13, 14, and 15, opposite of openable end panel 11 by way of a groove-and-tongue (or tab-and-slot) joint. More specifically, at least a portion of the lips 12*a-d* (see, e.g., FIG. 5) of removable end panel 12 may be in the form of a tongue (or tab) and at least a portion of one or more edges of side panels 13, 14, and 15, opposite of foldable end panel 11 may be in the form of grooves (or slots) for secure attachment, or at least a portion of removable end panel 12 may be in the form of a groove (or slot) and at least a portion of one or more edges of side panels 13, 14, and 15, opposite of foldable end panel 11 may be in the form of tongues (or tabs) for secure attachment. The secure attachment between the lips 12*a*-12*d* of removable end panel 12 and one or more of foldable side panels 13, 14, 15 may also be accomplished by alternative means such as a male-female connection, hooks, latches, buttons, Velcro, or any suitable means as understood by a person of ordinary skill in the art. In one non-limiting embodiment, removable end panel 12 may be permitted to slide in and out of opening 24, such that when removable end panel 12 is slid into opening 24 it securely attaches to one or more of foldable side panels 13, 14, and 15. These embodiments are not intended to be limiting.

Figure 5:
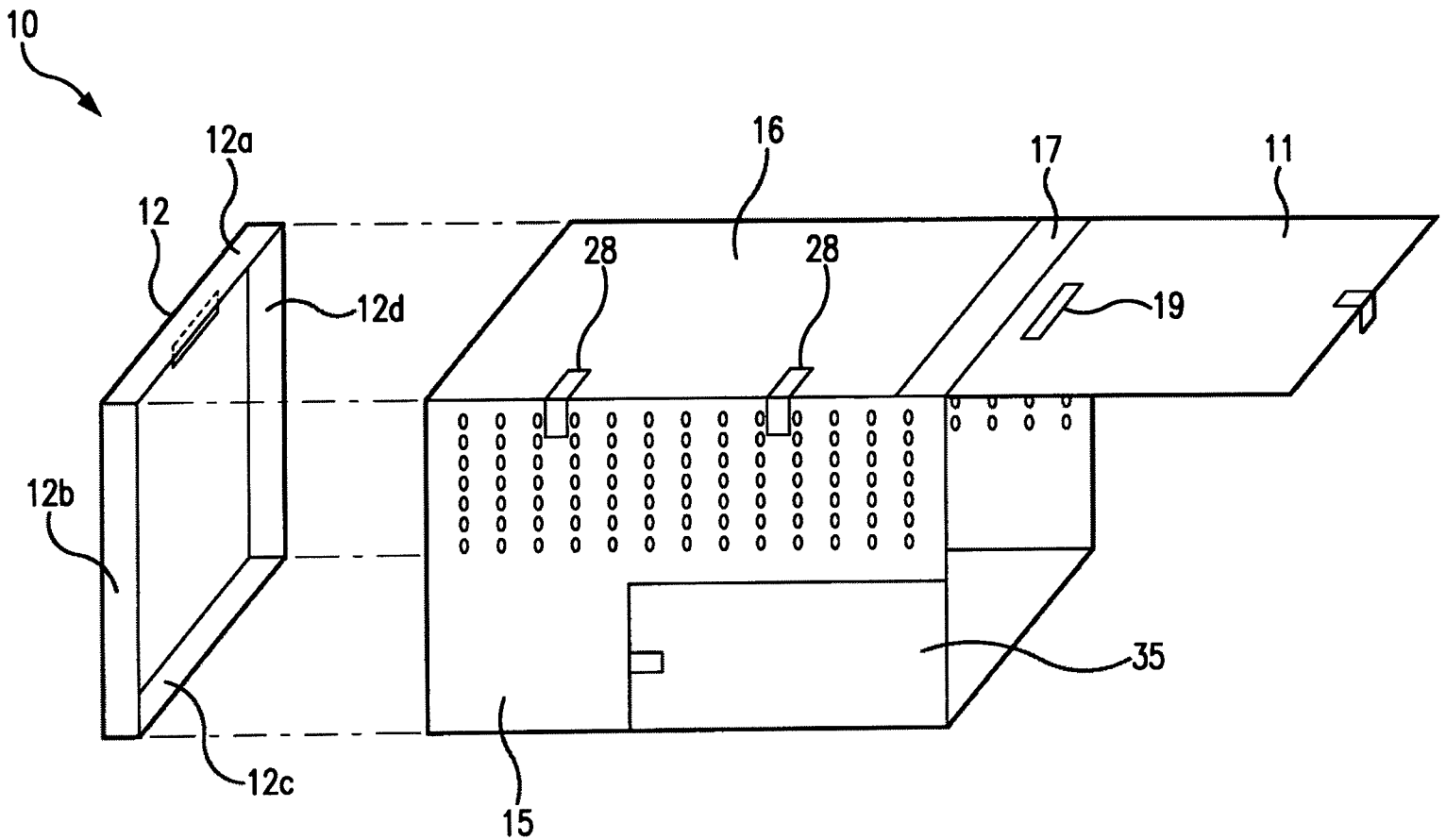
FIG. 5 illustrates a perspective view of the collapsible structure with the removable end panel removed.

FIG. 5 is a perspective view of collapsible structure 10 in which removable end panel 12 is removed or disconnected from collapsible structure 10 and foldable end panel 11 is in the open position. Removable end panel 12 is considered removed or disconnected from secure attachment to one or more of foldable side panels 13, 14, and 15 when removable end panel 12 does not prevent collapsible structure 10 from folding into the collapsed state. When removable end panel 12 is removed or disconnected from secure attachment to one or more of foldable side panels 13, 14, and 15, and foldable end panel 11 is in the open position; foldable side panels 13, 14, and 15, openable side panel 16, and partial side panel 17 are permitted to fold, along seams 18 into a flat collapsed state, as shown in FIG. 6.

Figure 6:
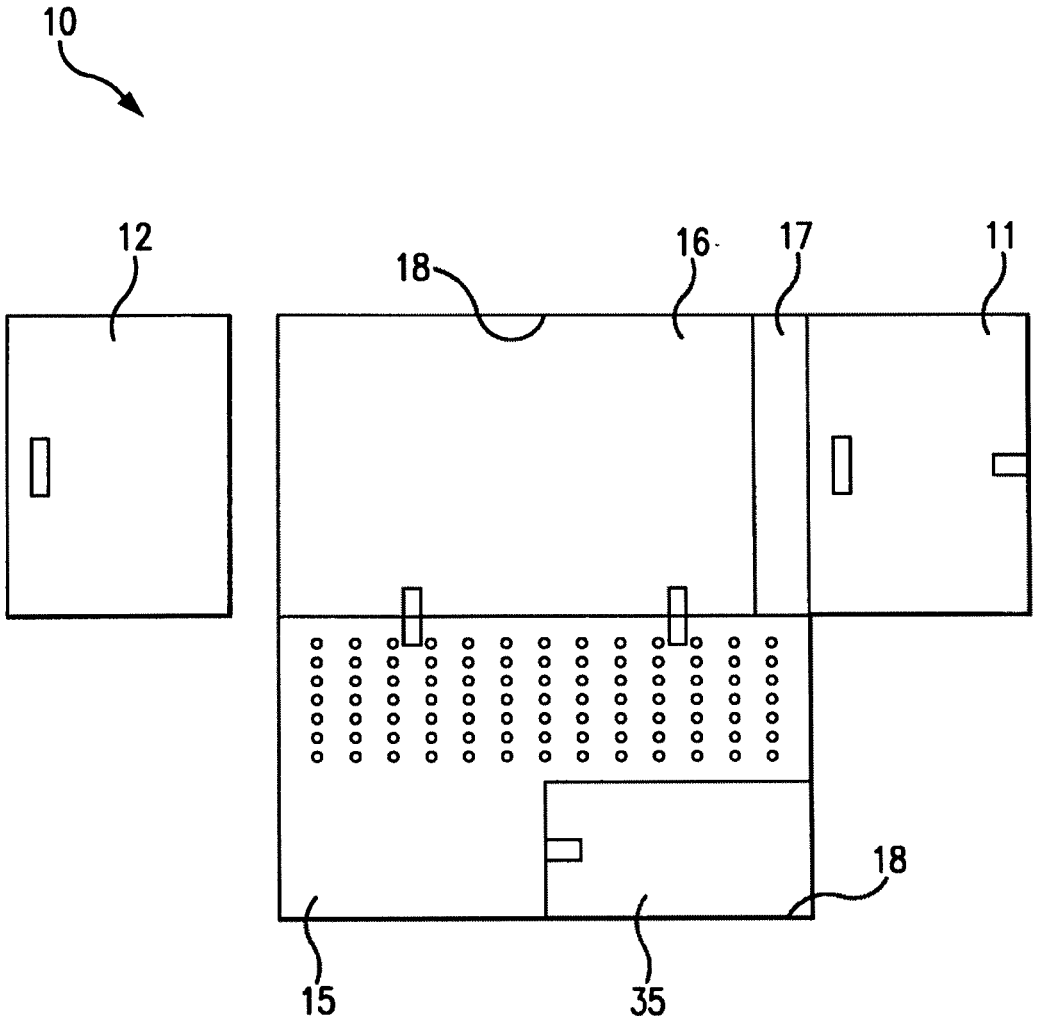
FIG. 6 illustrates a top view of the collapsible structure while in the collapsed state.

FIG. 6 shows a top view of collapsible structure 10 while in the collapsed state. In one non-limiting embodiment, while folded in the collapsed state, openable side panel 16 and partial side panel 17 may be disposed on-top-of foldable side panel 13, while foldable side panel 15 may be disposed on foldable side panel 14. In this manner, the height of collapsible structure 10, while in the flat collapsed state, may be defined by the thickness of the side panels. The collapsible state may permit the user to easily store collapsible structure 10 within a typical apartment or dormitory, for example under a bed or couch. In one non-limiting embodiment, removable end panel 12 may include foldable seams, such that removable end panel 12 may also fold into a collapsed state.

Figure 7:
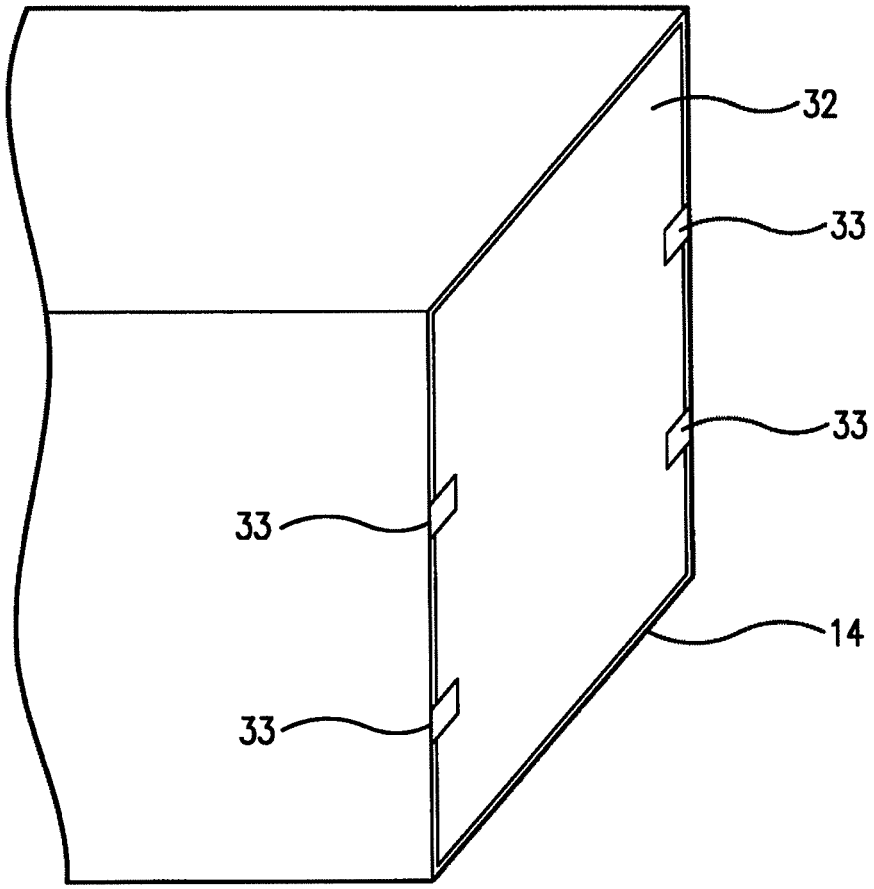
FIG. 7 illustrates a perspective view of an alternative embodiment of the collapsible structure.

FIG. 7 is a perspective view of one non-limiting embodiment in which collapsible structure 10 may further include heat resistant sheet 32. As shown in FIG. 7, heat resistant sheet 32 may be securely attached to a foldable side panel (e.g. 14) by one or more attachments 33. Attachments 33 may be brackets, clamps, clips, or other suitable means for securely attaching heat resistant sheet 32 to foldable side panel 14. When in the ironing board state, the user may remove heat resistant sheet 32 and place it over openable panel 16, partial side panel 17, and openable end panel 11 to create a heat resistant ironing surface if collapsible structure 10 is not made of heat resistant material or to further reinforce the heat resistance of collapsible structure 10 during ironing. The size, shape, orientation, and configuration of heat resistance sheet 32 as shown in FIG. 7 is not intended to be limiting; the size of the sheet may be larger or smaller (and of different shape and of different orientation or configuration) than shown.

Embodiments of the present invention have been fully described above with reference to the drawing figures. Although the invention has been described based upon these preferred embodiments, it would be apparent to those of skill in the art that certain modifications, variations, and alternative constructions could be made to the described embodiments within the spirit and scope of the invention.

What is claimed is:

1. A collapsible structure, comprising:

a removable end panel;

an openable end panel;

a partial side panel;

a first seam connecting the openable end panel to the partial side panel and configured to permit the openable end panel to pivot about the first seam from a first closed position to a first open position;

an openable side panel;

a first foldable side panel;

a second foldable side panel;

a third foldable side panel;

a second seam connecting the first foldable side panel to the partial side panel;

a third seam connecting the first foldable side panel to the second foldable side panel;

a fourth seam connecting the second foldable side panel to the third foldable side panel;

a fifth seam connecting the third foldable side panel to the openable side panel and the partial side panel, and wherein the fifth seam is configured to permit the openable side panel to pivot about the fifth seam from a second closed position to a second open position;

wherein the removable end panel is configured to connect to one or more of the first foldable side panel, the second foldable side panel, and/or the third foldable side panel by one or more attachment, and wherein the first foldable side panel, the second foldable side panel, the third foldable side panel, the openable side panel, the partial side panel, and the foldable end panel are configured to fold into a collapsed state when the removable end panel is not connected to one or more of the first foldable side panel, the second foldable side panel, and/or the third foldable side panel, and the openable end panel is not in the first closed position.

2. The collapsible structure according to claim 1, further comprising a support which is configured to secure the openable end panel in the first open position such that the openable end panel is parallel with the openable side panel.

3. The collapsible structure according to claim 2, wherein the support is configured to be permanently affixed to the openable end panel and temporarily attached to the first foldable side panel.

4. The collapsible structure according to claim 2, wherein the support is configured to be permanently affixed to the first foldable side panel and temporarily attached to the openable end panel.

5. The collapsible structure according to claim 2, wherein the support is configured to be temporarily attached to the first foldable side panel and temporarily attached to the openable end panel.

6. The collapsible structure according to claim 2, further comprising a storing mechanism configured to store the support when the support is not positioned to secure the openable end panel in the first open position.

7. The collapsible structure according to claim 2, wherein the collapsible structure is adapted for use as an ironing board.

8. The collapsible structure according to claim 1, further comprising one or more ventilation holes.

9. The collapsible structure according to claim 1, further comprising a partial foldable end panel configured to be temporarily attached to the first foldable side panel while in a third open position, and configured to be temporarily attached to the third foldable side panel while in a third closed position.

10. The collapsible structure according to claim 1, wherein the removable end panel further comprises a first handle and the openable end panel further comprises a second handle.

11. The collapsible structure according to claim 10, wherein the first and second handles are formed by removed portions of each of the removable end panel and the openable end panel.

12. The collapsible structure according to claim 1, wherein the removable end panel is configured to connect to one or more of the first foldable side panel, the second foldable side panel, and/or the third foldable side panel by a groove-and-tongue mechanism.

13. The collapsible structure according to claim 1, wherein the removable end panel is configured to connect to one or more of the first foldable side panel, the second foldable side panel, and/or the third foldable side panel by Velcro.

14. The collapsible structure according to claim 1, wherein the removable end panel further comprises one or more seams, such that the removable end panel is configured to be folded into a collapsed position.

15. The collapsible structure according to claim 1, wherein the openable side panel is configured to be temporarily attached to the first foldable side panel.

16. The collapsible structure according to claim 15, wherein the openable end panel is configured to be temporarily attached to the second side panel.

17. The collapsible structure according to claim 1, wherein the openable end panel is configured to be temporarily attached to the second side panel.

18. The collapsible structure according to claim 1, further comprising an attachment and a reciprocating attachment that are configured to attach the openable side panel to the first foldable side panel.

19. The collapsible structure according to claim 18, further comprising an attachment and a reciprocating attachment that are configured to attach the openable end panel to the second side panel.

20. The collapsible structure according to claim 1, further comprising an attachment and a reciprocating attachment that are configured to attach the openable end panel to the second side panel.

* * * * *